United States Patent [19]

McManus

[11] 4,335,769

[45] Jun. 22, 1982

[54] FOLDABLE CONTAINER

[76] Inventor: Gerald P. M. McManus, The Old Parsonage, Peaslake, Surrey, England

[21] Appl. No.: 192,898

[22] Filed: Oct. 1, 1980

[30] Foreign Application Priority Data

May 7, 1980 [GB] United Kingdom ..... 8015147

[51] Int. Cl.[3] ..... B65D 33/14

[52] U.S. Cl. ..... 150/1; 224/275

[58] Field of Search ..... 150/1, 7; 224/275, 901

[56] References Cited

U.S. PATENT DOCUMENTS

| | | | |
|---|---|---|---|
| 784,559 | 3/1905 | Graham | 150/7 |
| 1,656,339 | 1/1928 | Runyan | 224/275 |
| 2,283,069 | 5/1942 | Knuetter | 150/1 X |
| 2,507,842 | 5/1950 | Waddill | 150/1 X |
| 2,689,594 | 9/1954 | Wendt | 150/1 |
| 2,767,895 | 10/1956 | Smith | 224/275 |
| 2,894,675 | 7/1959 | Stein | 224/901 X |
| 3,014,759 | 12/1961 | Bing | 224/275 X |
| 3,151,649 | 10/1964 | Mitchell | 150/7 X |
| 3,187,903 | 6/1965 | Oltz | 150/1 X |
| 3,510,052 | 5/1970 | Ruda | 150/7 X |

*Primary Examiner*—Donald F. Norton

*Attorney; Agent, or Firm*—McCormick, Paulding & Huber

[57] ABSTRACT

A container bag made of a thin foldable plastics sheet material includes a rectangular body portion (2) defined by front and rear walls (4) and (6). The central part of the rear wall (6) extends upwardly to define a trapezoidal rib (22). A first rectangular adhesive region (28) is formed on the rear face of the rib (22) along its length, and covered by a readily removable backing strip (30). A second adhesive region (32) is formed on the lower part of the rear wall (6), and also covered by a readily removable backing strip (34).

The bag is folded and inserted in the rack on the rear of a passenger seat. A passenger can open out the bag, remove the backing strip (30) and press the adhesive region (28) against the upper portion of the seat in front. The secured bag is then ready to receive used articles. If desired, the backing strip (34) can be removed from the second adhesive region (32) which is then pressed against a lower portion of the forward seat.

The bag is particularly suitable for motor cars, motor coaches and aircraft.

1 Claim, 2 Drawing Figures

FOLDABLE CONTAINER

TECHNICAL FIELD

The present invention relates to a container bag that can be folded relatively flat for storage in a rack. The invention is particularly concerned with but not restricted to a container bag intended for use by aircraft passengers and cleaning staff.

In operating an airline the problem arises that a considerable amount of rubbish such as discarded bottles and cartons accumulates in the aircraft cabin during flight. This means that the cleaning staff have to spend a considerable amount of time locating and removing this rubbish.

It is an aim of the invention to alleviate the aforementioned difficulty, and accordingly the invention envisages a foldable container bag having an opening in an upper portion thereof through which the bag can be filled, and an adhesive region along an upper rear part of the bag whereby the bag can be supported on a suitable support structure.

In a preferred embodiment of the invention the container bag is generally rectangular in cross-section with the opening extending along what will be the upper edge of the bag. The central part of the bag rear wall extends upwardly from the opening, and the adhesive region extends along the rear face of this part.

A second adhesive region may be located at a lower part of the rear wall outer face for attaching the bag to a lower part of the support structure. Consequently if the container bag is attached to the rear of an aircraft seat, then if the seat is inclined extensively the bag is not suspended in the lap of the person sitting immediately behind.

FIGURES IN THE DRAWINGS

An embodiment of the invention will now be described by way of example with reference to the accompanying illustrative drawings in which:

FIG. 1 is a perspective view from above of the front of a container bag of the invention, and FIG. 2 is a perspective view from below of the rear of the container bag of FIG. 1.

DETAILED DESCRIPTION OF DRAWINGS

Figure 1:
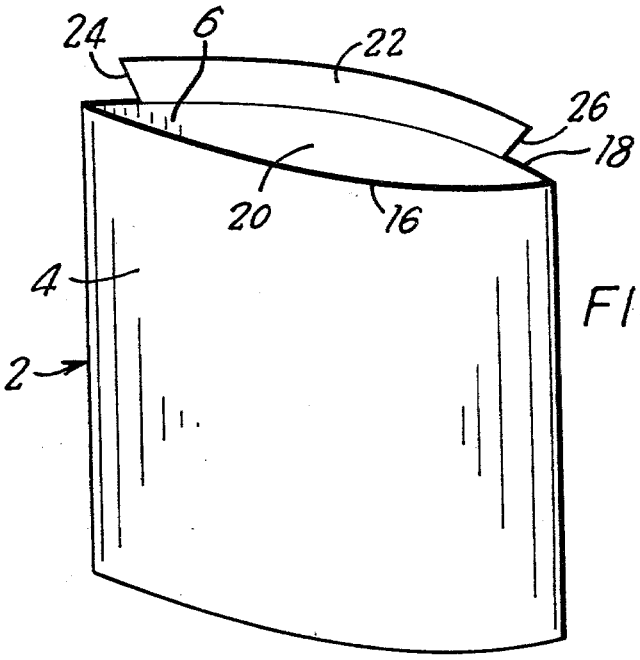
Figure 2:
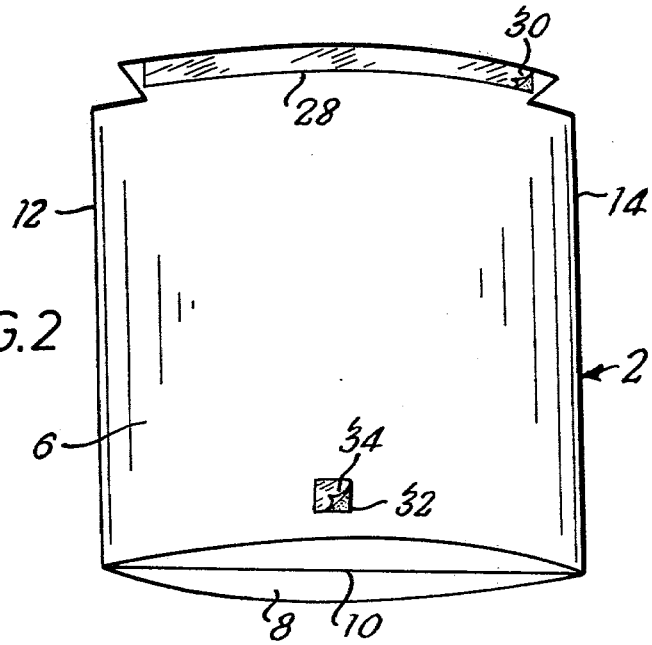

Referring to the drawings, a container bag of the invention is made of a suitable thin, foldable plastics sheet material, and includes a generally rectangular body portion 2. This body portion is defined by front and rear walls 4 and 6 and a base 8 which is turned upwardly and inwardly and is folded about a central fold line 10 so as to enable the body portion 2 to be opened out to receive its contents. The side edges 12 and 14 of the front and rear walls 4 and 6 are secured together, and the upper edges 16 and 18 of the walls 4 and 6 are unsecured so as to define the bag opening 20. The central part of the rear wall 6 extends upwardly from its upper edge 18 to define a rib 22. The ends 24 and 26 of the rib 22 are tapered inwardly towards the upper edge 18 so that the rib 22 is of trapezoidal shape.

A first generally rectangular adhesive region 28 is formed on the rear face of the rib 22 along substantially its entire length. This adhesive region 28 is covered by a conventional paper backing strip 30 which can be readily peeled off to expose the adhesive region 28. A second adhesive region 32 is formed on the lower central part of the rear wall 6, and is also covered by a readily peelable backing strip 34 similar to the backing strip 30. This region 32 is generally square in shape and considerably smaller than the first adhesive region 28.

In operation, the bag is folded flat and inserted into the conventional rack located on the rear of each aircraft passenger seat. It will be readily understood that this rack will face the passenger sitting immediately behind. During flight, when the passenger wishes to dispose of used bottles, cartons, wrapping paper and similar articles he removes the bag from the rack. He then opens out the bag, removes the backing strip 30 and presses the adhesive region 28 against the rear upper portion of the seat in front. This causes the bag to be secured to this seat, and the bag is then ready to receive the used articles. If the passenger in front wishes to recline his seat to any appreciable extent, then of course the bag will be suspended in the lap of the passenger using the bag. To overcome this inconvenience, the backing strip 34 can be removed from the second adhesive region 32 which is then pressed against a suitable lower portion of the forward seat. Now that the bag is secured by an upper and a lower region to the seat in front, the bag will not suspended vertically into the lap of the rear passenger.

It is to be understood that a container bag of the invention can be of any suitable size, shape and material. It can have its opening at any suitable region of the bag, and if desired it may have a closure flap for the opening. In addition, the container bag can have any desired number of suitably positioned adhesive regions.

It is to be understood that the container bag of the invention has a wide field of application, including for example motor cars, motor coaches and aircraft.

I claim:

1. A foldable generally rectangular container bag having a single opening in an upper portion thereof through which the bag can be filled, said bag having substantially coextensive front and rear walls connected together along opposite side edges and a foldable bottom wall secured to the front and rear walls and operable to allow the bag through opposite outward bowing of said front and rear walls to open for filling of the bag through its said upper opening, and said bag having a central part of its rear wall extending above the opening and substantially across the width of the opening, a strip of adhesive with a removable backing strip extending along said upwardly extending central part substantially from end to end and on a rearwardly facing surface thereof, said strip of adhesive serving to somewhat inhibit bowing of said rear wall adjacent the fill opening when adhered to a flat seat back or the like, and a second adhesive region with a removable backing strip on a rearwardly facing surface of the bag rear wall spaced substantially below said first adhesive strip and near the bottom of the bag, the width of said second adhesive region being substantially less than the width of said rear wall so as not to inhibit bowing thereof as aforesaid below said fill opening when adhered to a seat back or the like.

* * * * *